US008176887B2

(12) United States Patent
Golz et al.

(10) Patent No.: US 8,176,887 B2
(45) Date of Patent: May 15, 2012

(54) ELECTROMAGNETIC ACTUATING DEVICE

(75) Inventors: Thomas Golz, Messkirch (DE); Thomas Schiepp, Seitingen-Oberflacht (DE)

(73) Assignee: Eto Magnetic GmbH, Stockach (DE)

( * ) Notice: Subject to any disclaimer, the term of this patent is extended or adjusted under 35 U.S.C. 154(b) by 326 days.

(21) Appl. No.: 12/665,262

(22) PCT Filed: Jun. 19, 2008

(86) PCT No.: PCT/EP2008/004935

§ 371 (c)(1),
(2), (4) Date: Dec. 17, 2009

(87) PCT Pub. No.: WO2008/155119

PCT Pub. Date: Dec. 24, 2008

(65) Prior Publication Data

US 2010/0192885 A1 Aug. 5, 2010

(30) Foreign Application Priority Data

Jun. 19, 2007 (DE) ..... 10 2007 028 600

(51) Int. Cl.
*H01F 7/122* (2006.01)
*F01L 1/14* (2006.01)

(52) U.S. Cl. ..... 123/90.48; 335/229; 335/285

(58) Field of Classification Search ..... 310/22–24; 123/90.48; 355/229, 285, 288
See application file for complete search history.

(56) References Cited

U.S. PATENT DOCUMENTS

| | | | | |
|---|---|---|---|---|
| 5,653,422 | A * | 8/1997 | Pieloth et al. | 251/129.2 |
| 5,757,093 | A * | 5/1998 | Susliaev et al. | 310/24 |
| 6,085,704 | A | 7/2000 | Hara | |
| 6,354,253 | B1 | 3/2002 | Katsumata et al. | |
| 6,953,016 | B2 * | 10/2005 | Karbstein et al. | 123/90.48 |
| 2004/0201441 | A1 | 10/2004 | Elendt et al. | |

FOREIGN PATENT DOCUMENTS

| | | |
|---|---|---|
| DE | 19611547 A1 | 9/1997 |
| DE | 19819401 C1 | 9/1999 |
| DE | 10240774 | 4/2003 |
| EP | 1002938 | 5/2000 |

* cited by examiner

*Primary Examiner* — Burton Mullins
(74) *Attorney, Agent, or Firm* — Bachman & LaPointe, P.C.

(57) ABSTRACT

An electromagnetic actuating device comprising a plurality of electromagnetic actuation units (10, 12, 14), which can be selectively controlled for exerting an actuating force on a corresponding plurality of elongated tappet units (22, 24, 26) that are supported axially parallel, wherein the actuation units are provided in a common housing (18, 20; 78, 82) along the actuating direction axially parallel to each other, and form a contact surface that is at least planar in some sections and can be axially moved in the actuating direction at each associated engagement end facing the tappet units. A face (34, 36, 38) on the engagement side of each of the tappet units interacts with the engagement surface (28, 30, 32), wherein at least one of the plurality of tappet units sits eccentrically and/or with only a partial surface, with the face thereof on the engagement side, on the engagement surface of the associated actuation unit, particularly adheres to it magnetically.

11 Claims, 6 Drawing Sheets

Fig. 15
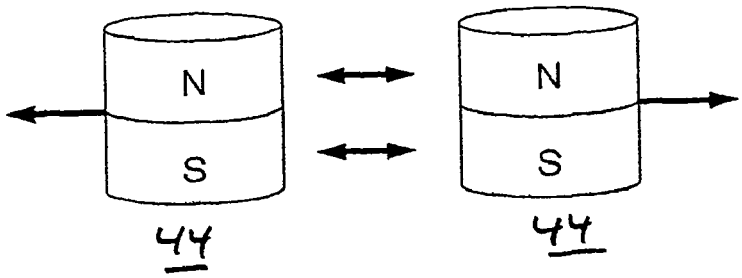
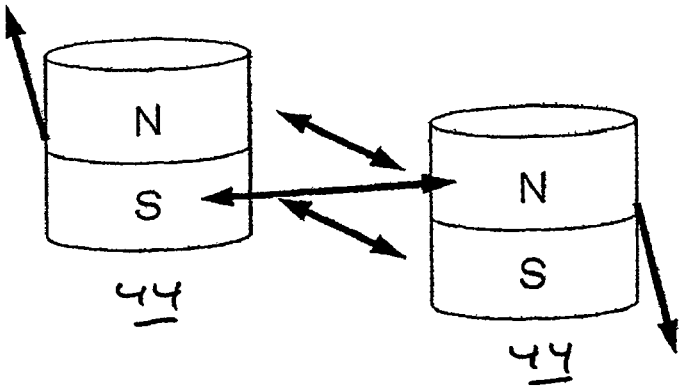
Fig. 16
Fig. 17
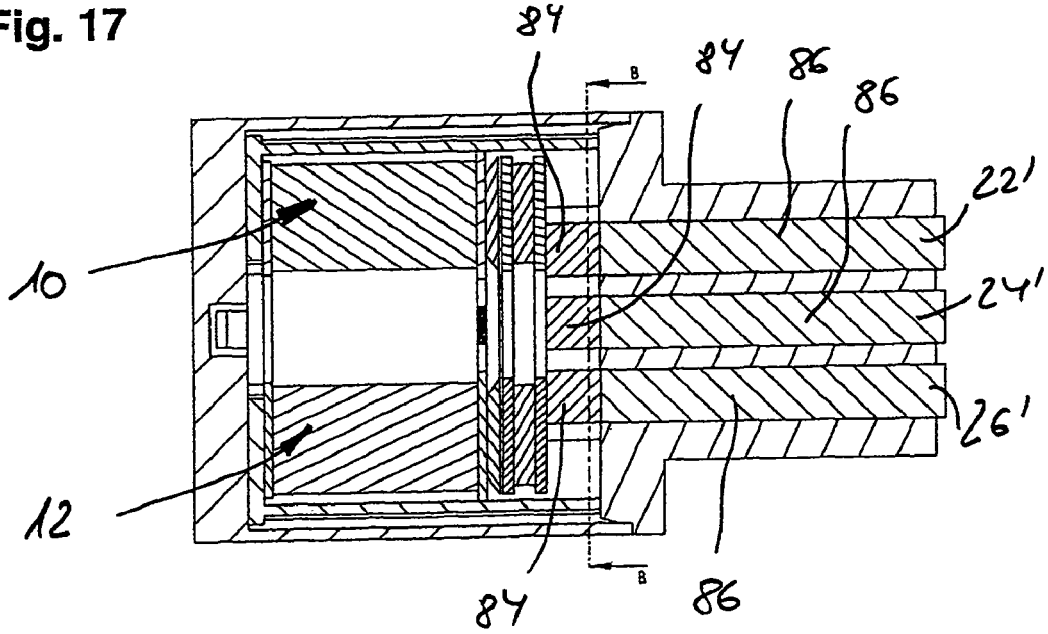

ELECTROMAGNETIC ACTUATING DEVICE

BACKGROUND OF THE INVENTION

The present invention relates to an electromagnetic actuation device. Devices of this type are generally known from the prior art and are used for manifold actuation tasks, for example in connection with internal combustion engines.

On account of limited installation space in an installation location, the requirement often exists to realise a generic actuation device for a respective actuation task sufficiently compactly using a plurality of (typically selectively controllable, that is to say controllable independently of one another) tappet units, so that on the one hand a satisfactory electromagnetic functionality is ensured (for example with regard to the required actuation travel of the tappet units and also reaction or switching time) and on the other hand no undesired reciprocal influencing—mechanical or electromagnetic—is present.

It is therefore known from the prior art to realise actuation tasks which require a plurality of actuator units with the aid of individual actuator units, which are fixed or provided independently of one another, wherein this leads to increased configuration and installation outlay and usually the compactness of the overall arrangement is only limited.

This problem is aggravated by the fact that the use environment provided for the device, which environment necessitates the engagement of a plurality of tappet units, often predetermines that the tappet units may be closely adjacent to one another and often may only be distanced from one another by a predefined maximum spacing; this is often not achievable or only achievable with restrictions with separate, individually fixed actuator units.

The applicant's German Patent Application 102 40 774 shows an example for a known actuator unit, for example.

It is therefore the object of the present invention to create an electromagnetic actuation device with a plurality of electromagnetic actuator units according to the preamble of the main claim, which can be used in particular even in use locations with restricted installation space, as well as in particular beneficially under use conditions which predetermine a limited maximum spacing of the tappet units from one another.

SUMMARY OF THE INVENTION

The object is achieved by means of the electromagnetic actuation device with a plurality of electromagnetic actuator units, which can be selectively controlled for exerting an actuation force on a corresponding plurality of elongated tappet units, characterised in that the actuator units are provided in a housing along their actuation direction preferably axially parallel to one another, in each case form a working surface which is at least sectionally flat and can be axially moved in the actuation direction at one engagement end facing and in each case assigned one of the tappet units, and interacts with an engagement-side end face of a respective one of the tappet units using the engagement surface, wherein at least one of the plurality of tappet units rests using its engagement-side end face excentrically and/or using only a part surface on the engagement surface of the associated actuator unit, particularly adheres thereto magnetically.

In an advantageous manner according to the invention, the plurality of actuator units is first provided (wherein a particularly preferred realisation form of the invention provides at least three actuator units with three tappet units accordingly) in a preferably cylindrical and/or hollow cylindrical housing. According to the invention, the elongated (even preferably cylindrical, even more preferably realised from a metal material) tappet units are driven in that the tappet units rest on an engagement surface of a respective assigned actuator unit (preferably adhere there by means of magnetic action), wherein the engagement surface typically forms the distal end of an armature unit of the relevant actuator unit.

According to the invention, the object of an arrangement of the tappet units next to one another which is as compact as possible can then be achieved in that—in the case of adjacent actuator units which are driven parallel to one another—respective tappet units which rest thereon interact with the engagement surfaces excentrically or with their end faces on the engagement side in such a manner that an arrangement which is as compact as possible of the tappet units, which are preferably guided axially parallel to one another takes place, thus—in accordance with the predetermined actuation or use conditions—minimal axial spacings of the tappet units from one another can be realised.

In the context of a preferred embodiment of the invention, it is in this case beneficially provided that the common housing which accommodates the actuator units interacts at the end face side with a housing guiding section (guide tube), which offers guides—typically in the form of through holes which run in parallel to one another—for the plurality of the tappet units.

According to a preferred embodiment of the invention, at least one of the actuator units is realised in a space-saving manner and at the same time electromagnetically optimised manner by means of a flux-conducting actuator casing unit, which is of bow-shaped construction. In this manner, the packing density of the plurality of actuator units in the common housing can be increased further, particularly on account of the fact that the actuator units are arranged in such a manner that respective actuator casing units of adjacent actuators do not touch one another.

In the context of preferred developments of the invention, it is additionally beneficial to create the armature unit from a widened armature section, which armature section has a permanent magnet and at least one armature disc provided thereon (preferably for forming the engagement surface), wherein this widened armature section then merges axially into an elongated armature tappet section, which is guided in a core (preferably a core having a corresponding guide hole). The core (core unit) can then itself preferably accommodate a compression spring provided in accordance with development, which compression spring acts against the armature, and/or have a through hole for fluids (particularly air) for the further movement optimisation by means of pressure equalization. The compression spring provided in accordance with development has proven advantageous, particularly with respect to an optimisation of switching time at low temperatures; in the retracted state of the armature unit, the compression spring is pretensioned by means of the armature tappet section. As soon as current is then applied to the coil unit, the retaining force of the permanent magnet on the core is initially weakened. Additionally, the repelling force acts between coil unit and permanent magnet, as a result of which the armature moves due to the spring force and the repulsion between the permanent magnet and coil unit as soon as the magnetic field has been built up.

According to a further preferred embodiment, at least one of the (metallic) tappet units is provided with a plurality of sections in the axial direction: a first, magnetically optimised section of the tappet unit forms the end face on the engagement side, that is to say interacts with the engagement surface of the armature unit, whilst an opposite second tappet section is optimised with respect to hardness and wear properties, more or less for the purpose of interaction with a downstream actuation assembly. A realisation of this type of a plurality of sections of the tappet unit can in this case take place either by means of suitable material influence of a one-piece unit, alternatively in the context of preferred developments, the tappet unit can be assembled in a suitable manner by means of a plurality of individual sections, wherein, in this regard, the disclosure content of the applicant's German Utility Model Application 20 2006 011 905 should be regarded as belonging to the present invention and as included in the present disclosure. Thus, it is suitable in a beneficial manner in accordance with development to realise the first magnetically optimised section of the tappet unit by means of a soft-magnetic material, wherein ferromagnetic metals (such as iron, cobalt, nickel) are further preferably beneficially suitable for realisation. By contrast, it is preferred in accordance with development in the context of the invention to realise the second tappet unit from austenitic material, wherein here in particular cold forming methods can increase the hardness of the second section further. In this case it is not necessary to realise the tappet unit from two separate workpieces, rather it can be provided within the context of the present invention, for example to form the second, wear-optimised section by means of a hardened (e.g. by a heat treatment) section of an otherwise soft-magnetic material.

Whilst the present invention is particularly suitable for realising actuation tasks by means of three tappet units which run axially parallel to one another and in one plane, advantageously for camshaft displacement for an internal combustion engine for example, the present invention is not limited to this. The spacing of two tappet units which are guided towards one another can also advantageously be optimised in particular in the context of the invention, just as realisation forms are conceivable, in which more than three tappet units are driven in a compact and space-saving manner by means of an associated actuator unit in each case. Whilst the axially parallel guiding of the tappet units may additionally be the typical realisation form, the present invention is not limited to this; rather it is sufficient for the realisation of the advantages according to the invention if merely one component of the motion vector of each tappet unit runs in the actuation direction, wherein skew directions of extension of the tappet units or directions of extension of the tappet units which are inclined with respect to one another in some other manner in particular are also comprised by the present invention. The guiding of the tappet units in a common housing is also the typical realisation form, yet variants are conceivable and comprised in the context of the invention, in which variants respective tappet units are guided in separate individual housings which are correspondingly adjacent to one another.

As a result, what emerges by means of the present invention in a surprisingly simple and elegant manner is an arrangement which combines a compact design with ease of installation, a high degree of operational reliability and optimal switching-time and magnetic properties.

BRIEF DESCRIPTION OF THE DRAWINGS

Further advantages, features and details of the invention result from the following description of preferred exemplary embodiments, as well as on the basis of the drawings; in the drawings:

FIG. 15, FIG. 16 show schematic diagrams to clarify the magnetic interaction of the permanent magnets of two adjacent actuator units in the retracted state (FIG. 15) and in the extended state of an actuator unit (FIG. 16);

FIG. 17 shows a longitudinal section analogous to FIG. 5 to clarify a further embodiment with tappet units which consist of a plurality of functional sections.

DETAILED DESCRIPTION

Figure 1:
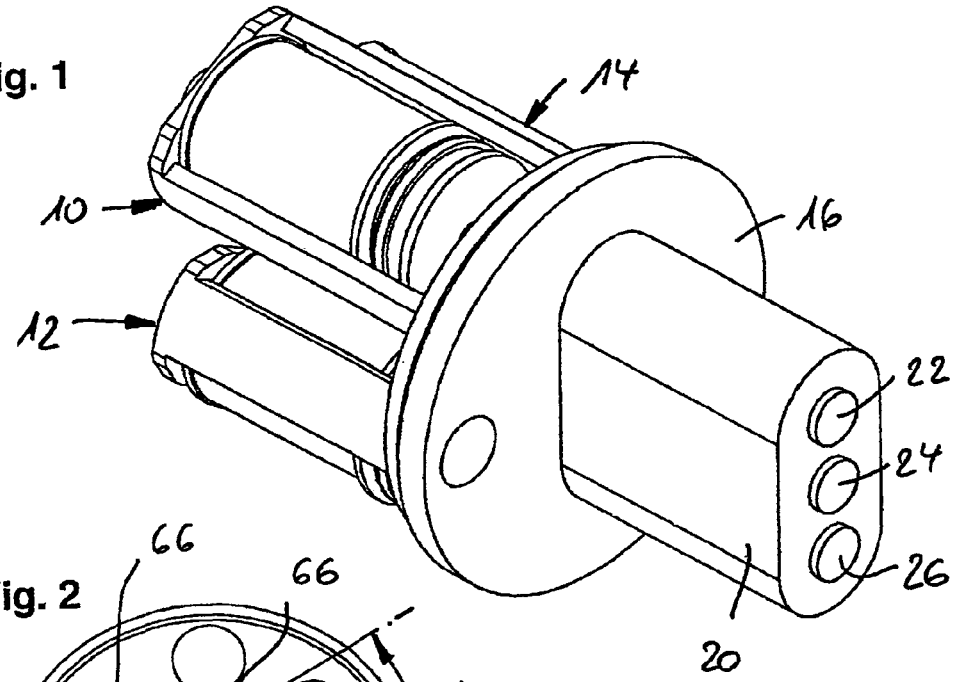
FIG. 1 shows a perspective view of the electromagnetic actuation device according to a first preferred embodiment of the invention (with the housing removed)
Figure 2:
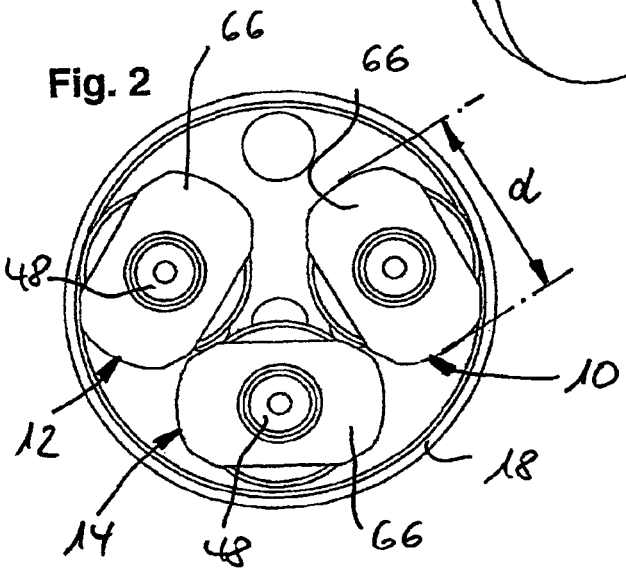
FIG. 2 shows a rear view/plan view onto the arrangement according to FIG. 1.
Figure 3:
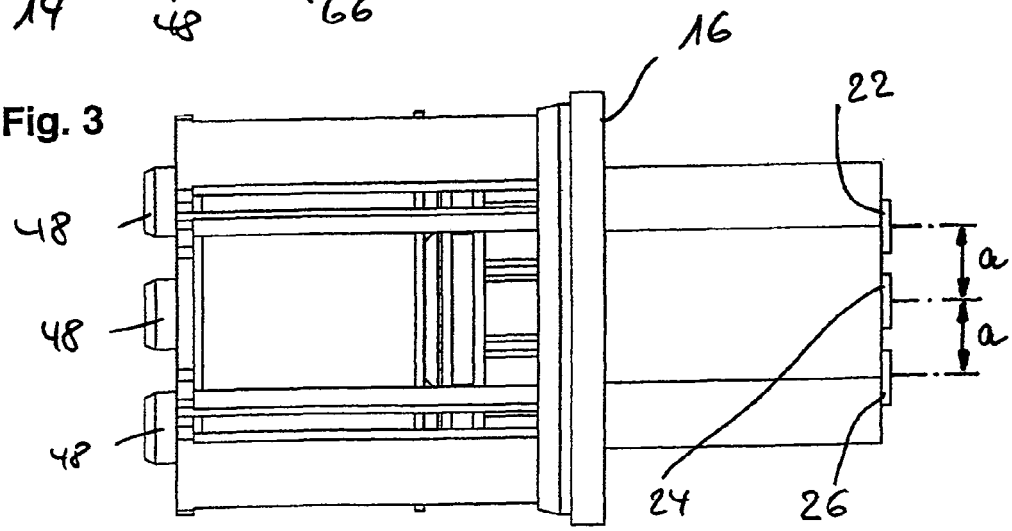
FIG. 3 shows a side view onto the arrangement according to FIG. 1.

FIGS. 1 to 3 for the first exemplary embodiment show how three actuator units 10, 12, 14 are arranged distributed in a housing (only a circular housing lid 16 is shown as a yoke) in such a manner that the actuator units 10 to 14 bear against a hollow cylindrical inner wall of a housing casing 18 (not shown in the FIGS. 1 and 3). A flat housing section 20 on the engagement side sits on the housing lid (yoke) 16, which flat housing section has three openings next to one another in an extension plane for guiding three tappet units 22, 24, 26, which tappet units are mounted axially parallel in the manner shown and can be driven selectively in a manner to be described below by means of an assigned one of the actuator units 10, 12, 14.

In the case of a typical external housing diameter of 40 mm, a maximum diameter d (FIG. 2) of one of the actuator units 10 to 14 is approx 17 mm; the arrangement shown can, in the case of an assumed diameter of the elongated cylindrical tappet units 22, 24, 26 of 5 mm, therefore realise an average axial spacing a of the tappet units of 7 mm in the manner shown in FIG. 3, in accordance with the installation and actuation conditions on a downstream assembly, in the present exemplary embodiment a camshaft control for an internal combustion engine, which camshaft control can be actuated (not shown) by the three tappets 22, 24, 26.

Figure 4:
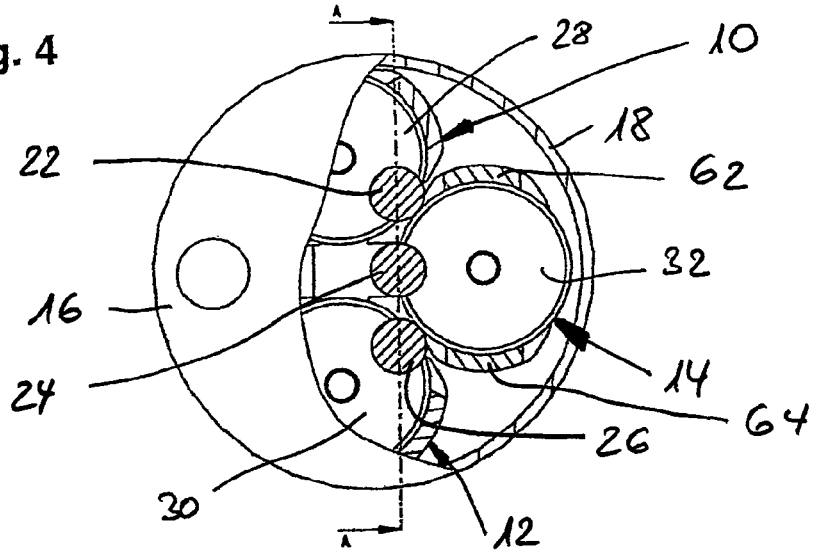
FIG. 4 shows a sectional view through the exemplary embodiment according to FIG. 1 to FIG. 3 (with housing) along a section line B-B in FIG. 5.
Figure 5:
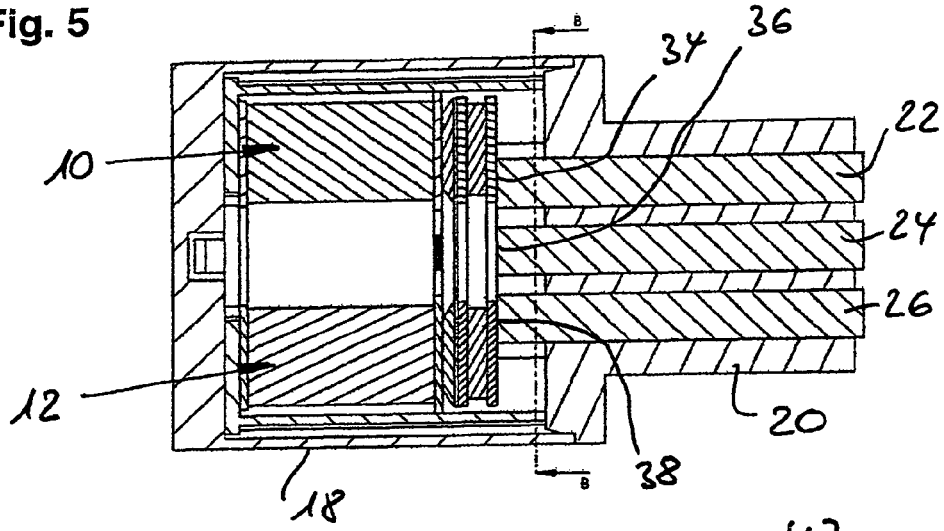
FIG. 5 shows a longitudinal section through the device according to FIG. 4 along the section line A-A.

The image views of FIGS. 4 and 5—(in a deviation from FIGS. 1 and 3, the cylindrical housing casing 18 is also shown here) in particular clarify the geometric relationships in the transition between the actuator units 10 to 14 (more precisely the engagement-side engagement surfaces 28, 30, 32 of the actuator units) and the end faces 34, 36 and 38 directed towards them in each case: it emerges, cf. in particular the section view of FIG. 4, that the tappet units 22, 24, 26 in each case rest excentrically on the disc-shaped engagement surfaces 28 to 32, wherein the likewise circular end faces 34 to 38 partially project beyond a respective outer edge of the engagement surfaces 28 to 32 of the actuator units, in the manner shown in FIG. 4. In this manner, the geometry shown can then be achieved, namely tappet units 22 to 26, which are closely adjacent to one another, nevertheless moveably guided independently of one another, with minimised spacing to one another (in the exemplary embodiment a=7 mm, cf. FIG. 3). In this case, the tappet units have flat end faces in the exemplary embodiment shown, as for example shown in FIG. 5. These can have another contouring however, for example a convex (spherical) outer shape, in order to take account of a possible circumstance that in alternative realisation forms, the movement direction of the actuator units does not correspond to the movement direction of the tappet units, rather, for example, the tappet units are inclined (also relatively to one another) with respect to the movement direction of the actuator units (or their engagement surfaces 28 to 32).

Figure 6:
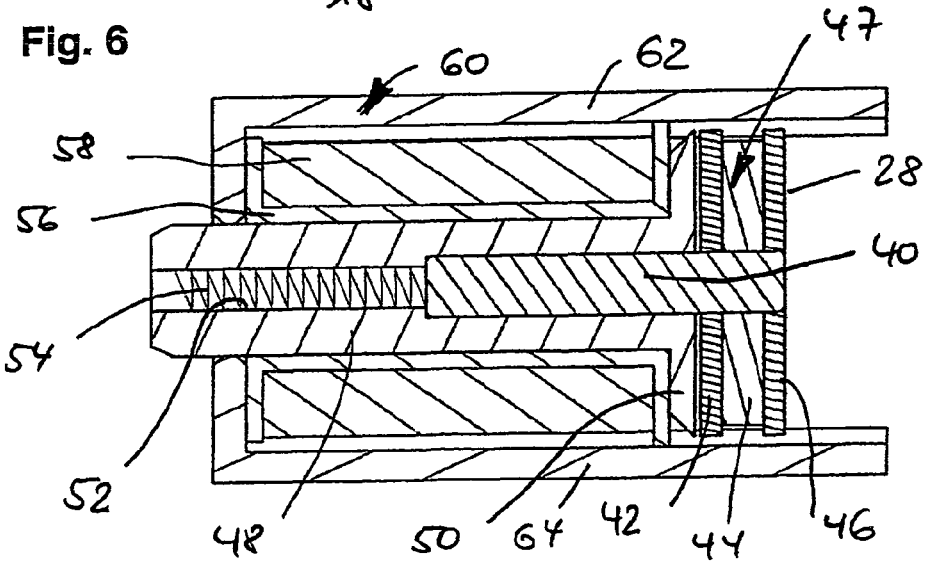
FIG. 6 shows a longitudinal section through an actuator unit according to the exemplary embodiment of FIG. 1 to FIG. 5.
Figure 7:
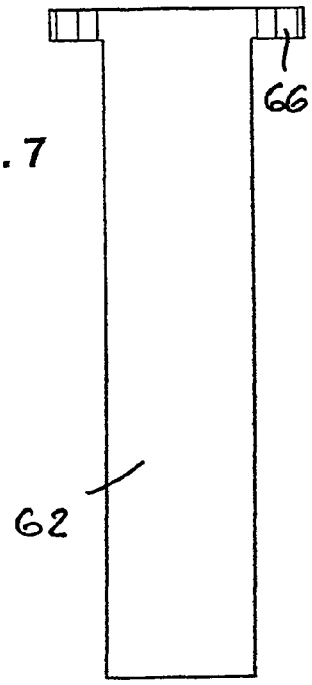
FIG. 7, FIG. 8 show detail views turned through 90° of the bow-shaped flux-conduction element (actuator casing unit) for use in the actuator unit according to FIG. 6.
Figure 8:
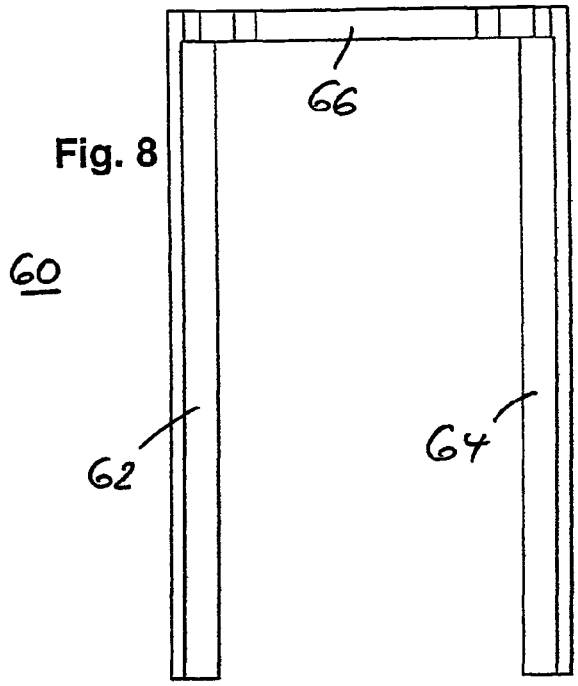

The FIGS. 6 to 8 clarify constructive details of the three actuator units 10 to 12: an armature created from an elongated, cylindrical armature tappet section 40 as well as a widened armature section 47, itself formed in a layered manner from an armature disc 42, a permanent magnet disc 44 and also a pole disc 46, forms one of the engagement surfaces 28 to 32 on the outer surface of the pole disc 46 and is guided in an elongated hollow cylindrical core element 48, which, opposite the armature disc 42, forms an annular collar section 50 and has a through hole 52 along its axial direction of extension, which, to optimise the fluid flow, enables a free air flow in the arrangement for example and is furthermore constructed to accommodate a compression spring 54, which, in the stopped state of the armature shown in FIG. 6, pretensions the latter in its rightwards-directed movement direction.

The yoke element 48 is initially enclosed in turn by a coil unit which has a coil former 56 and also a winding 58 and is itself sectionally enclosed in the circumferential direction by a bow-shaped flux-conduction element 60, which offers an opening for a narrow end of the yoke element 48 at one end and opens into two free limbs 62, 64 at the other end, which limbs delimit the actuation path of the armature (and therefore also of the pole disc 46 with engagement surface).

The FIGS. 7 and 8 show the bow-shaped flux-conduction element 60 in detail; the limbs 62 and 64 are formed in the manner of sections of an elongated cylinder and sit integrally on a bottom section 66. Variants of this exemplary embodiment additionally provide, in the context of the present invention, that the bow-shaped flux-conduction element 60 has only one limb and another of the limb pair 62 or 64 can be omitted. Although this leads to a reduction of the magnetic properties, it potentially enables the further condensing of a plurality of actuator units formed therewith to a compact structure.

Figure 9:
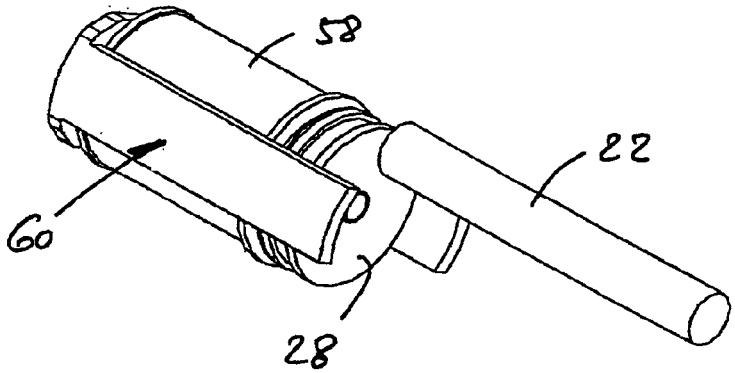
FIG. 9, FIG. 10 show a perspective as well as side view to clarify the interaction between an actuator unit (FIG. 6 to FIG. 8) with a tappet unit which interacts excentrically as well as over part of a surface.
Figure 10:
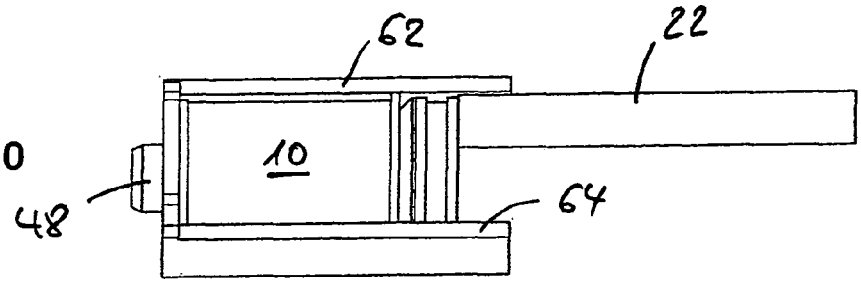

The FIGS. 9 and 10 clarify, as an isolated illustration of an actuator unit with a tappet unit, how—in the case of practically unimpaired electromagnetic functionality—the bow-shaped flux-conduction unit 60 only encloses the arrangement made up of the coil unit, yoke element and armature unit in opposite sections in the circumferential direction, and at the same time establishes the possibility for the part of the end face of the tappet unit 22 shown to project at the edge beyond the engagement surface 28.

The FIG. 2 clarifies, in this respect, how the elongated-disc-shaped bottom sections 66 and the limbs 62, 64 of the respective flux-conduction elements are placed in such a manner that—to minimise the packing density in the hollow-cylindrical housing—no reciprocal influencing of the flux-conduction elements 60 takes place, rather the (lower) external diameter of the coil units can be used effectively for space minimisation.

The FIGS. 11 to 14 show an alternative realisation form of the present invention according to a second exemplary embodiment. This exemplary embodiment provides only two tappet units 70, 72, which are moved by associated actuator units 74 or 76 in each case. The actuator units 74 and 76 correspond constructively to the realisation explained on the basis of FIGS. 6 to 8 and sit in a common housing 78 in the exemplary embodiment shown, which common housing has a flat contour (the reference number 80 schematically shows a fixing flange for the housing arrangement 78).

Figure 12:
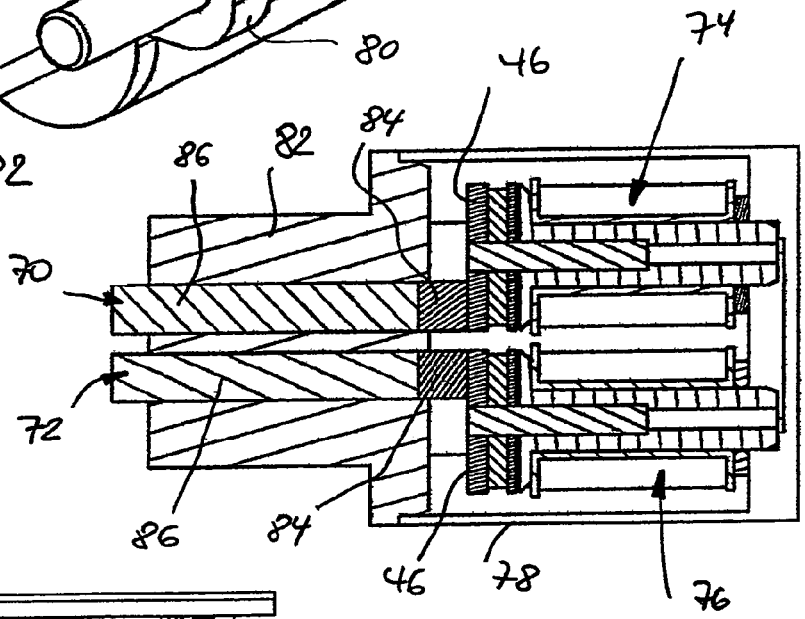
FIG. 12 shows a longitudinal section through the device according to FIG. 11.

As the section view of FIG. 12 in particular clarifies, the elongated cylindrical tappet units 70, 72 are in turn guided in a front housing section 82 in such a manner that they can be moved parallel to one another while minimising their axial spacing (in turn approx. 7 mm), wherein, as FIG. 12 allows to be seen, the tappet units 70, 72 in each case rest, in the manner according to the invention, excentrically on the outer engagement surfaces formed by a respective pole disc 46 (or adhere there magnetically).

In the exemplary embodiment shown it additionally becomes clear that the tappet units 70 and 72 here consist in each case of two sections, a first magnetically optimised section 84 and also a second section 86 seated thereon in the longitudinal direction, which is adapted for optimised interaction with an end-side engagement partner in particular, for example by means of suitable hardening (or other forms of treatment for wear resistance or the like). In the exemplary embodiment shown, a respective one of the tappet units 70, 72 is assembled from two suitable metal materials for the sections 84 and 86; other alternatives for the realisation of the plurality of sections are conceivable, just as is a use of the two-part tappet units in the context of the first exemplary embodiment of FIGS. 1 to 10 (to this extent, FIG. 17 shows this variant as a further exemplary embodiment, wherein identical function components are provided with the same reference numbers and the tappet units 22', 24' and also 26' are accordingly two-part variants). With respect to the realisation of the first section 84 or the second section 86, reference is made to the applicant's DE 20 2006 011 905 U1; according to which the use of a soft-magnetic or ferromagnetic material for the first section is particularly beneficially suitable, whilst, for example, an austenitic material is beneficial for the realisation of the second section and both sections are permanently connected to one another by means of suitable bonding methods. Alternatively, for example the second section can, in the context of preferred developments, also be realised by means of hardening, or similar measures, of an otherwise magnetically beneficial (e.g. soft-magnetic) material.

Figure 11:
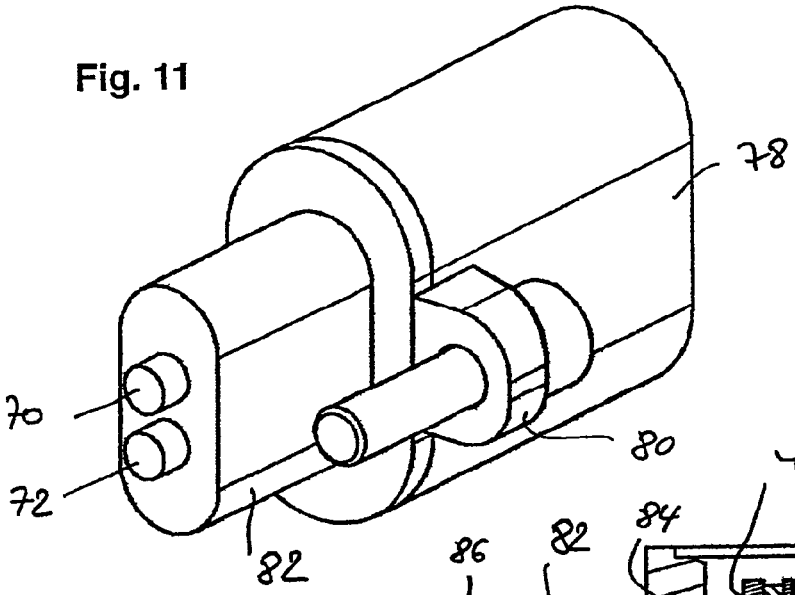
FIG. 11 shows a perspective view of the electromagnetic actuation device according to a second embodiment of the present invention with two tappet units.
Figure 13:
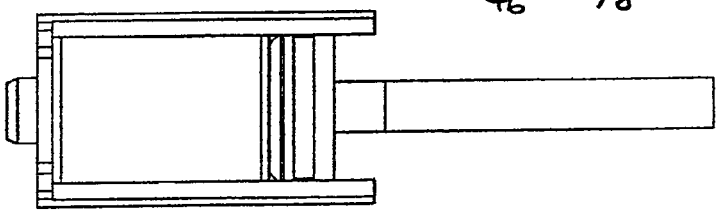
FIG. 13, FIG. 14 show detail views to clarify the interaction of an actuator unit of the exemplary embodiment of FIG. 11 and FIG. 12 with a tappet unit.
Figure 14:
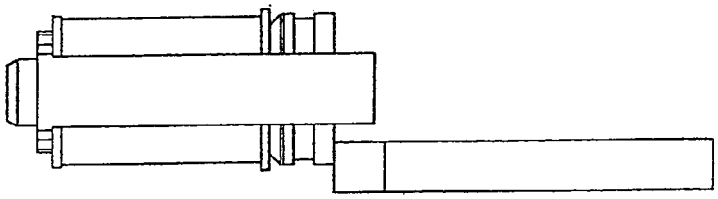

For the exemplary embodiment of FIG. 11 and FIG. 12, the detail views of FIG. 13 and FIG. 14 in turn clarify the excentric or also laterally projecting resting of the tappet units on a respective engagement surface.

FIG. 15 and FIG. 16 clarify a magnetic interaction between two adjacent actuator units, wherein this applies both for the first exemplary embodiment with three tappet units and for the second exemplary embodiment with two tappet units: FIG. 15 schematically shows how, in the retracted state of two adjacent actuator units, the respective permanent magnet disc 44 (magnetised in the axial direction) is located at the same height in each case, in other words, and as is shown by the double arrow in FIG. 15, a repulsion effect of the respective same magnetic poles from one another results, so that a repulsion force between the respective armature units exists in this operating state. As soon as one of the actuator units is moved out of its rest position (that is to say approximately in accordance with FIG. 6), an attraction (clarified by the long double arrow) results between the south pole of the permanent magnet located on the left and the north pole of the permanent magnet shown on the right, whilst as before, the same-poled permanent magnet sections repel one another (short double arrows). As a result, the dynamic behaviour of the described exemplary embodiments is then improved by this configuration.

The present invention was only described in an exemplary manner on the basis of the exemplary embodiments; in the exemplary embodiment shown, an axial spacing of three adjacent cylindrical tappet units (which in each case had a diameter of 5 mm) of only 7 mm was realised in the case of a diameter of the housing casing of approx. 40 mm. With an effective travel of the actuator movement of 4 mm, a switching time of between approx. 20 and 22 ms (12 to 22, up to 100 ms at −35° C.) can be realised.

Figure 18:
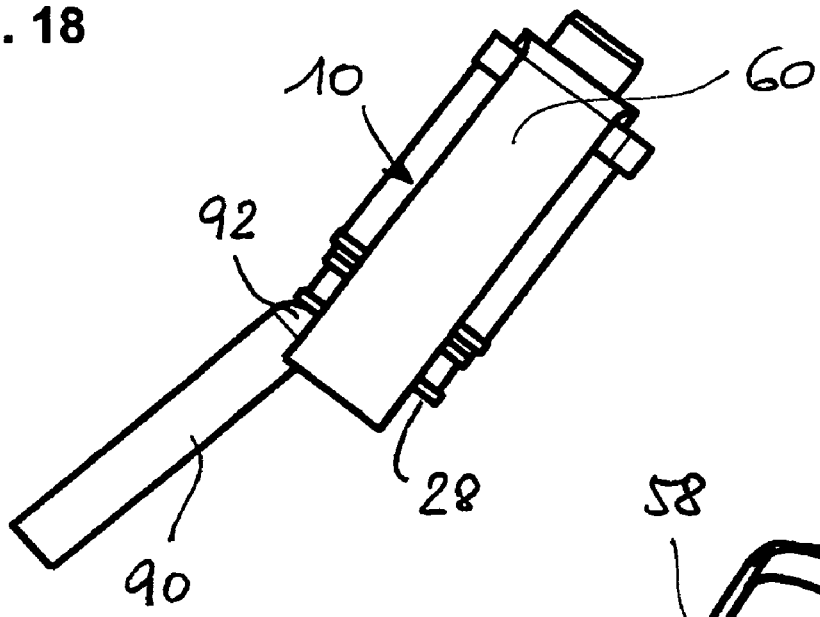
FIG. 18, FIG. 19 show a side and perspective view of a variant of the present invention of a tappet unit which is inclined relatively to an actuator movement direction, which tappet unit additionally has a spherically curved end face for interacting with the actuator.
Figure 19:
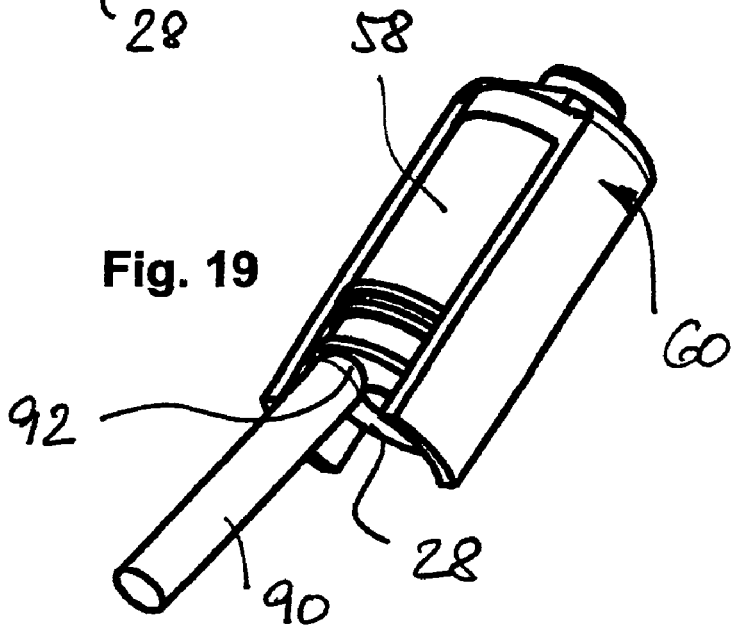

Whilst the previously described exemplary embodiments require that actuator and tappet unit are in each case guided and orientated axially parallel to one another, the present invention is not limited to this; rather it is possible in the context of preferred developments that the tappet units are inclined relatively to the actuators or their movement directions, as the tappet units can also be inclined relatively to one another (that is to say are e.g. guided in a skew manner), just as it is principally not ruled out that the movement directions of the plurality of actuators are also inclined relative to one another. FIGS. 18 and 19 clarify one such variant as a side or perspective illustration, namely a tappet inclined in its movement direction relatively to the actuator movement direction, which tappet additionally does not, at the end face, have a flat end face in its engagement region for the actuator, but rather has a spherical (concavely curved) end face.

A tappet unit 90 definitely rests on the engagement surface 28 of the actuator unit here, analogously to the illustration of FIGS. 9 and 10 (to this extent, the reference numbers for the actuator unit 60 remain), wherein however, in deviation from the tappet unit 22, the tappet unit 90 forms a convexly curved spherical end section 92 at the engagement side for interacting with the end face 28, so that a reliable interaction and a reliable force transmission between the units is ensured in the end region of the disc 28. The geometry which can be recognised from the illustrations of FIGS. 18 and 19 additionally clarifies that a movement direction of the tappet unit which runs through the longitudinal axis of the tappet unit 90 (the tappet unit is accordingly guided in an assigned housing—not shown—) is inclined relatively to the longitudinal or axial direction of the actuator unit. In turn, analogously to the embodiment of FIGS. 9 and 10, the tappet unit 90 rests on the disc-shaped surface 28 and can be held there e.g. by the action of a permanent magnet in an adhering manner.

The present invention is not limited to the configurations shown with two or three tappet units, but rather is also suitable in principle for a larger number of actuators and associated tappet units. Even if a preferred area of application of the present invention lies in the realisation of actuation tasks in the case of internal combustion engines, for example in camshaft displacement, the area of application of the present invention is in principle unlimited and is particularly effective where only a small installation space is available for a plurality of actuator units and yet respective tappets must fulfil their actuation purpose with only a very small spacing from one another at the same time.

The invention claimed is:

1. Electromagnetic actuation device comprising a plurality of electromagnetic actuator units for exerting an actuation force on a corresponding plurality of elongated tappet units, the actuator units are provided in a housing axially parallel to one another, each actuator unit has an engagement surface which is at least sectionally flat and is axially movable in an actuation direction for engagement with an end face of one of the tappet units, and interacts with an engagement-side end face of a respective one of the tappet units using the engagement surface, wherein at least one of the plurality of tappet units rests using an engagement-side end face which adheres magnetically to the associated actuator unit excentrically and/or using only a part surface on the engagement surface.

2. Device according to claim 1, wherein the plurality of actuator units are provided adjacent to one another in such a manner that the actuator units bear against a housing inner wall.

3. Device according to claim 1, wherein at least one of the actuator units has an armature unit which comprises a permanent magnet and forms the engagement surface at the end face, which armature unit can be moved by applying current to a stationary coil unit.

4. Device according to claim 3, wherein the coil unit is enclosed by an at least sectionally cylindrical or hollow cylindrical magnetically flux-conducting actuator casing unit in such a manner that the engagement surface can be moved in an open end of an actuator casing unit.

5. Device according to claim 4, wherein the actuator casing unit is formed in a bow-shaped manner in such a manner that a free limb of the actuator casing unit forms a circumferential delimitation of the armature unit and also the coil unit in the shape of hollow cylinder sections.

6. Device according to claim 3, wherein the armature unit has a widened armature section, having the permanent magnet, axially outside of the coil unit as well as an elongated armature tappet section sitting thereon, which armature tappet section is guided at least sectionally in an elongated core unit of the actuator unit enclosed by the coil unit.

7. Device according to claim 6, wherein the core unit is formed from magnetic material and/or has a passage which allows a fluid pressure equalization.

8. Device according to claim 3, wherein the armature unit is guided against the force of a compression spring acting against the armature tappet section.

9. Device according to claim 1, wherein the plurality of the electromagnetic actuator elements and the corresponding plurality of tappet units are at least 3 and the tappet units are guided relatively to the actuator units in such a manner that respective longitudinal axes of the tappet units lie in a common plane.

10. Device according to claim 9, wherein at least one of the tappet units in the region of the engagement-side end face forms a first ferromagnetic section for magnetic interaction with the associated actuator unit, and a second austenitic section which is opposite the first section along the direction of extension.

11. Device according to claim 1, wherein the actuation tasks are in an internal combustion engine for camshaft displacement.

* * * * *